United States Patent [19]

Lucas

[11] Patent Number: 4,882,804

[45] Date of Patent: Nov. 28, 1989

[54] PROTECTIVE MOP ATTACHMENT PLATE

[75] Inventor: Stephen W. Lucas, Westfield, Mass.

[73] Assignee: Standex International Corporation, Salem, N.H.

[21] Appl. No.: 282,580

[22] Filed: Dec. 12, 1988

[51] Int. Cl.[4] ..... A47L 13/20

[52] U.S. Cl. ..... 15/244.1; 15/119 A; 15/228

[58] Field of Search ..... 15/244.1, 228, 119 A, 15/244.2

[56] References Cited

U.S. PATENT DOCUMENTS

| | | | |
|---|---|---|---|
| 2,572,978 | 10/1951 | Bogan | 15/244.2 X |
| 2,698,955 | 1/1955 | Trindl | 15/244.1 |
| 2,840,843 | 7/1958 | Vavrinek | 15/244.1 |
| 4,658,461 | 4/1987 | Roe et al. | 15/244.2 X |

*Primary Examiner*—Chris K. Moore

*Attorney, Agent, or Firm*—Fishman, Dionne & Cantor

[57] ABSTRACT

An improved mop attachment plate for sponge mops and the like wherein said plate is provided with an upstanding lip portion adjacent the leading edge thereof for covering the leading edge of a mop frame whereby said frame is prevented from contacting and marring furniture and the like during use of the mop. Said attachment plate is preferably made from thermoplastic plastic materials.

4 Claims, 2 Drawing Sheets

PROTECTIVE MOP ATTACHMENT PLATE

BACKGROUND OF THE INVENTION

The present invention is an improvement to a device for attaching a mop to a mop frame and handle. More specifically the present invention is a furniture guard, molded into the mop attachment means to protect furniture from being scratched or dented by the metal mop frame.

While mops have been in existence for many years, there are basically only two common types of mops; the string or yarn mop and the sponge mop.

The string mop is comprised of a plurality cotton strings or pieces of yarn joined together by a common bracket, which is then attached to a handle. This type of mop, requires a special rinsing apparatus which squeezes the yarn free of water. This apparatus is separate from the mop and rests independently on the lip of a bucket.

The sponge mop is generally comprised of a rectangular box shaped sponge, held to an attachment means, which is further attached to a mop frame with handle. The sponge mop frame is generally comprised of two parts. The first part holds the mop and the mop handle, the other part is hinged to the first part and is used to squeeze moisture from the mop. The sponge mop offers the convenience of a self contained squeeze apparatus, which makes it much more practical than the yarn mop. This mop is found in most households and an example of same is disclosed in U.S. Pat. No. 3,188,676 to Zelinski et al.

While the sponge mop is in wide use, it has a disadvantage in that it is usually constructed with a metal frame. When the frame hits furniture, doors, walls and the like, it can mar them, resulting in unwanted nicks and scratches. Sponge mops have been available for at least the last twenty years and the denting or nicking problem has not been satisfactorily solved.

SUMMARY OF THE INVENTION

It is therefore a principal object of the present invention to provide a mop attachment means that will protect furniture and the like from nicks, scratches and dents.

It is another object of the present invention to provide such a mop attachment means wherein it is comprised of a fusible plastic material.

It is yet another object of the present invention to provide such a mop attachment means that is universal in application.

The above referenced objects and advantages of the present invention will become more readily apparent to and is understood by those skilled in the art from the following detailed description when considered in connection with the appended claim and accompanying drawings.

DESCRIPTION OF THE PREFERRED EMBODIMENT

Figure 1:
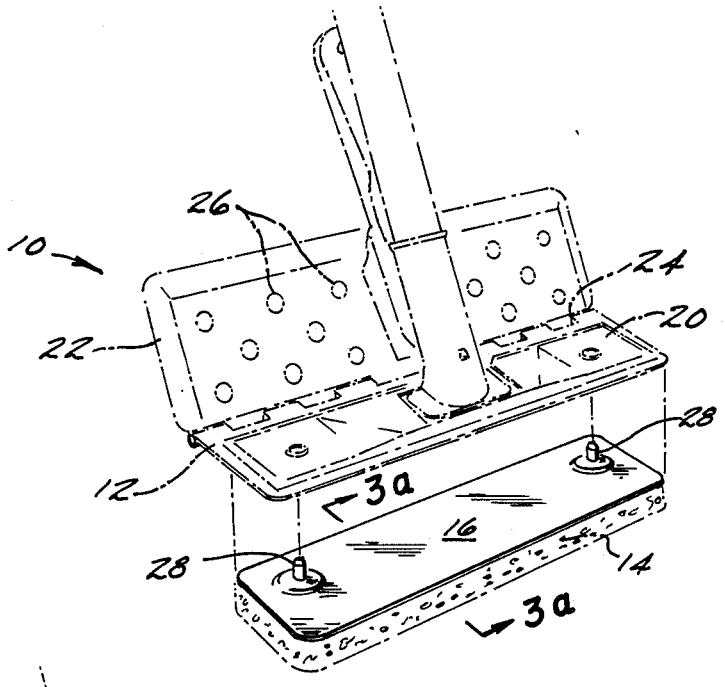
FIG. 1 PRIOR ART
FIG. 1 is an expanded front perspective view of a prior art mop.

Referring first to FIG. 1 a prior art mop is shown generally at 10. The mop 10 includes a frame 12 which comprises a support section 20 and a rinsing section 22, a head or sponge 14 and an attachment plate 16. As shown sections 20 and 22 are both generally rectangular in shape. As further shown support section 20 is attached to rinsing section 22 by a spring loaded hinge 24, which runs the full length of sections 22 and 24. Section 22 is provided with a plurality of holes 26 which allow moisture to exit therethrough when the sponge 14 is squeezed between sections 20 and 22.

In prior art mops, the sponge 14 is generally attached to the attachment plate 16, by either adhesive or mechanical fasteners. As shown the attachment plate 16 is rectangular in shape and has mop fastening means 28 disposed thereon on the surface opposite to that which is attached to the sponge 14. Said fastening means 28 is employed to join the attachment plate 16 to support section 20.

Figure 2:
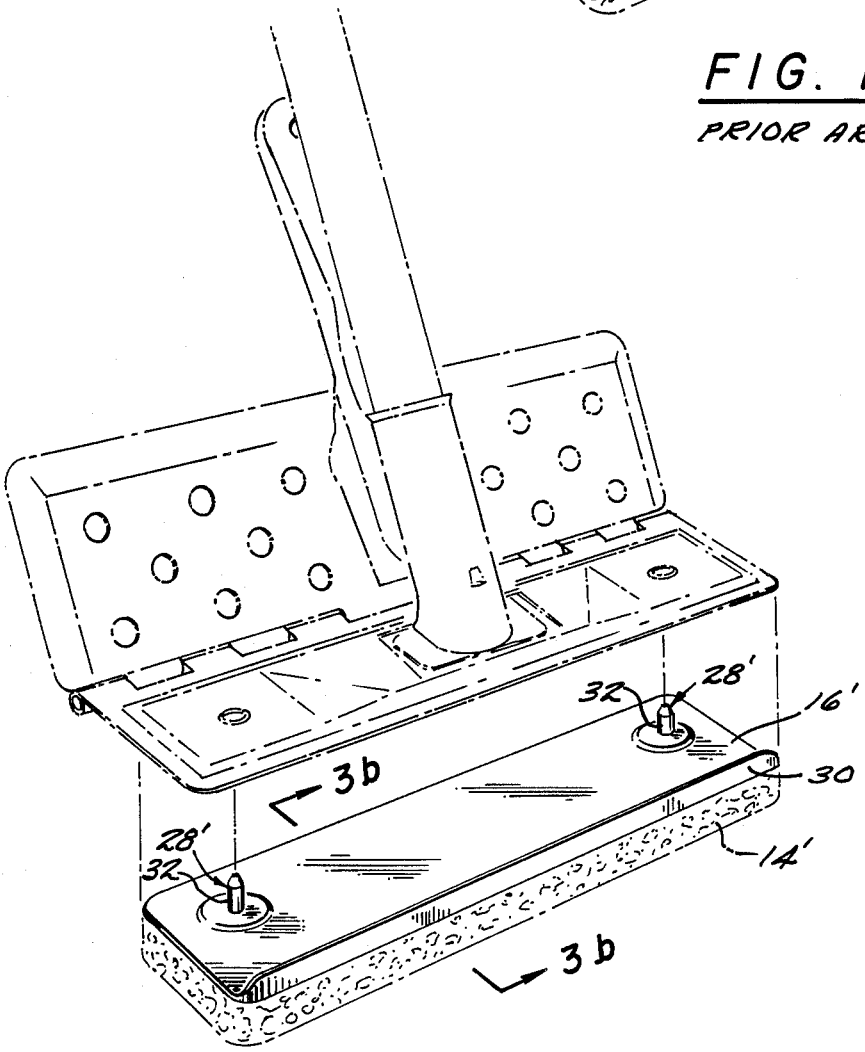
FIG. 2 is an expanded front perspective view of a mop with the mop attachment means of the present invention.
Figure 3A:
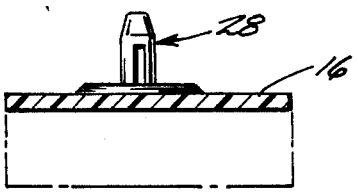
FIG. 3*a* is a cross sectional view along 3*a*—3*a* of FIG. 1.
Figure 3B:
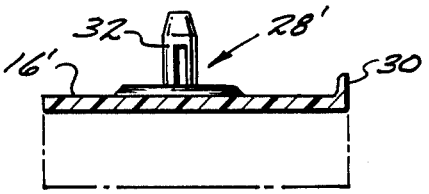
FIG. 3*b* is a cross sectional view along 3*b*—3*b* of FIG. 2.
Figure 4:
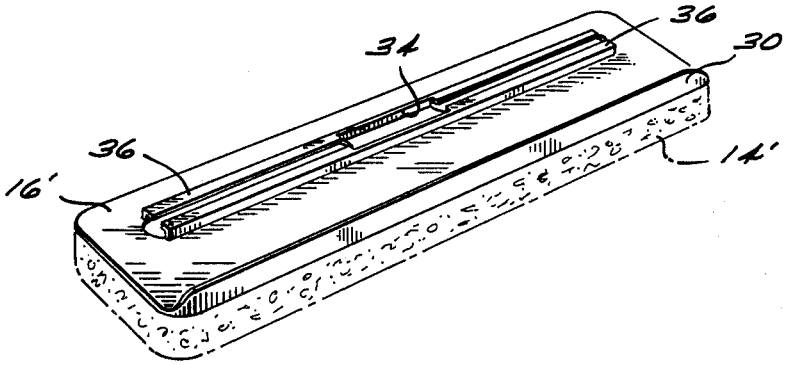
FIG. 4 is a front perspective view of an alternative embodiment of the mop attachment plate of FIG. 3.

Referring now to FIGS. 2–4 the mop attachment plate of the present invention is shown generally at 16'. Plate 16' is preferably constructed of thermoplastic materials such as polyolefins, PVC, etc. so as to permit the sponge 14' which is typically also formed from a synthetic plastic to be thermally sealed to plate 16'. This enables the use of heat and or ultrasonic welding to affix the sponge 14' to plate 16' in addition to adhesive and mechanical fasteners.

Plate 16' is provided with an upstanding lip 30 disposed adjacent one edge of said plate. As shown, the lip 30, extends across the entire length of said one edge and is preferably integral therewith. As shown lip 30 is triangular in cross section and has a height which is sufficient for the lip to cover the leading edge of the metal mop support section 20'. By covering the leading edge of mop support section 20', lip 30 protects furniture, walls and other similar objects from being marred by metal frame 12'.

Mop attachment plate 16' is also provided with fastening means 28' extending outwardly from the top surface of said plate 16'. As shown, said means is in the form of two plastic nipples 32 which in use extend into support section 20' for attaching the plate 16' thereto.

With reference to FIG. 4 an alternative embodiment of the attachment plate of the present invention is shown. As will be noted the plate 16' is provided with a partially open slot 34 having raised portions 36, which act as fastening means 28'. Said slotted portion 34 engage protrusions (not shown) or equivalent means which depend from the mop support section 20' for affixing the support section 20' to the attachment plate 16'.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. In a sponge mop having a metal frame, a sponge and an attachment plate affixed to said sponge for attaching said sponge to said frame, the improvement which comprises a lip disposed adjacent at least one edge of said attachment plate, said lip extending upwardly from the top surface of said plate in front of an edge of said frame so as to prevent said frame from contacting other objects, said attachment plate and said lip being integral and molded from a thermoplastic plastic.

2. The improvement of claim 1 wherein at least one of said edges of said attachment plate is the forward edge thereof.

3. An attachment plate for attaching a sponge to a mop frame, said attachment plate comprising a substantially flat plate, mop attachment means disposed on the surface of said plate opposite said sponge, an upstanding lip disposed adjacent one edge of said plate wherein said lip extends upwardly in front of an edge of said mop frame when said attachment plate is attached to said frame, said plate and said lip being integrally molded from a thermoplastic plastic.

4. The attachment plate of claim 3 wherein said thermoplastic plastic is a polyolefin.

* * * * *